US009068485B2

(12) United States Patent
Watanabe et al.

(10) Patent No.: US 9,068,485 B2
(45) Date of Patent: Jun. 30, 2015

(54) ENGINE LUBRICATION CONTROL SYSTEM

(71) Applicant: YAMADA MANUFACTURING CO., LTD, Kiryu-shi (JP)

(72) Inventors: Takatoshi Watanabe, Isesaki (JP); Hidehiko Koyashiki, Isesaki (JP); Junichi Miyajima, Isesaki (JP)

(73) Assignee: YAMADA MANUFACTURING CO., LTD., Kiryu-Shi, Gunma (JP)

( * ) Notice: Subject to any disclaimer, the term of this patent is extended or adjusted under 35 U.S.C. 154(b) by 0 days.

(21) Appl. No.: 14/012,881

(22) Filed: Aug. 28, 2013

(65) Prior Publication Data

US 2014/0060477 A1 Mar. 6, 2014

(30) Foreign Application Priority Data

Aug. 31, 2012 (JP) ..... 2012-191073

(51) Int. Cl.
*F01M 1/02* (2006.01)
*F01M 1/16* (2006.01)

(52) U.S. Cl.
CPC ..... *F01M 1/16* (2013.01)

(58) Field of Classification Search
CPC ..... F01M 1/02; F01M 1/16; F01M 3/00
USPC ..... 123/196 R, 196 CP, 196 V, 196 AA; 137/565.16, 625.65, 625.25, 528
See application file for complete search history.

(56) References Cited

U.S. PATENT DOCUMENTS 8,127,725 B2 * 3/2012 Crowe et al. ..... 123/90.15
8,146,550 B2 * 4/2012 Takemura ..... 123/90.17
8,297,240 B2 * 10/2012 Inoue et al. ..... 123/90.1
2008/0199796 A1 * 8/2008 Minemura et al. ..... 430/96
2009/0071140 A1 * 3/2009 Knecht et al. ..... 60/420
2009/0199796 A1 * 8/2009 Hisada et al. ..... 123/90.12
2011/0067668 A1 3/2011 Miyachi et al.
2012/0204823 A1 * 8/2012 Kanai ..... 123/90.12

FOREIGN PATENT DOCUMENTS

JP 2009-264241 A 11/2009

OTHER PUBLICATIONS

United States Office Action dated Jan. 28, 2015 in U.S. Appl. No. 14/012,872.
United States Notice of Allowance dated Apr. 14, 2015 in U.S. Appl. No. 14/012,872.

* cited by examiner

*Primary Examiner* — Lindsay Low
*Assistant Examiner* — Long T Tran
(74) *Attorney, Agent, or Firm* — McGinn IP Law Group, PLLC

(57) ABSTRACT

The present invention provides an engine lubrication control system including an engine, an oil pump which is driven by the engine, an oil circuit which extends downstream from the oil pump, and a plurality of oil branch supply paths which branch from the oil circuit and supply oil to each part of the engine. An electronically-controlled first hydraulic control valve which controls, in a stepwise manner, a discharge pressure of the oil pump relative to a speed of the engine is disposed on the oil circuit, a hydraulically-driven second hydraulic control valve is disposed on at least one of the plurality of oil branch supply paths, and a downstream hydraulic pressure of the second hydraulic control valve is controlled to be lower than a downstream hydraulic pressure of the first hydraulic control valve of the oil circuit at least across a predetermined engine speed range.

18 Claims, 8 Drawing Sheets

Fig. 1B
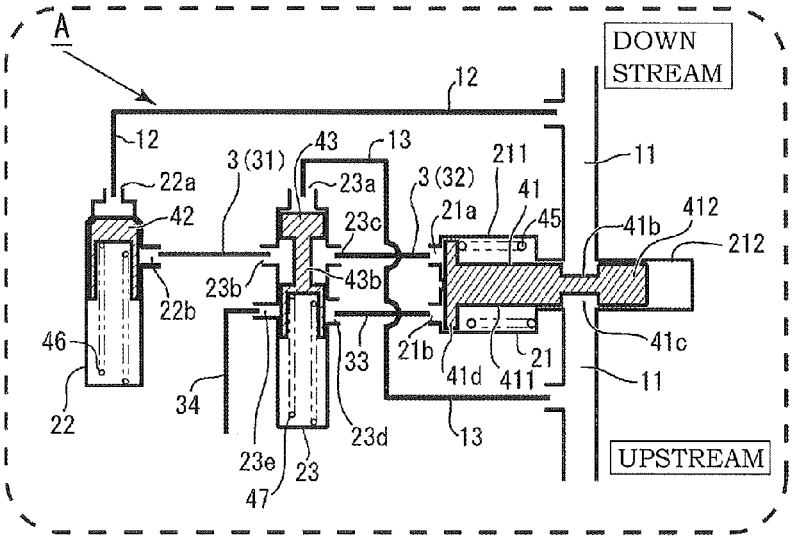
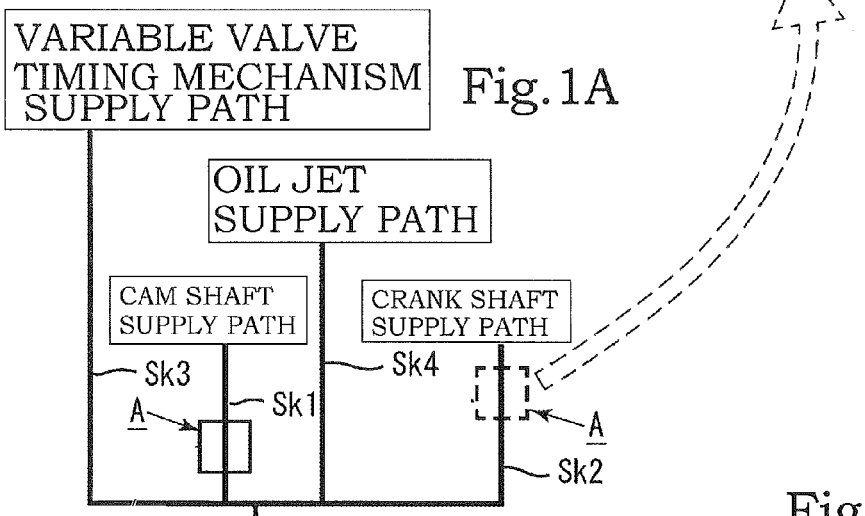
Fig. 1A
Fig. 1C
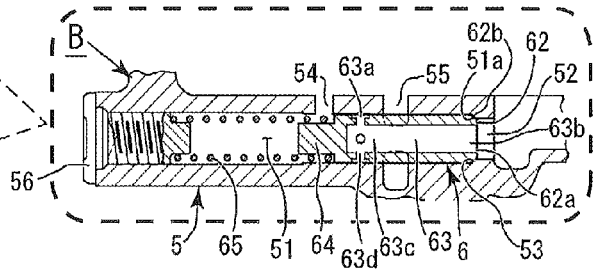

LOW ROTATIONAL RANGE

FIRST HYDRAULIC CONTROL VALVE

SECOND HYDRAULIC CONTROL VALVE

MID ROTATIONAL RANGE

FIRST HYDRAULIC CONTROL VALVE

SECOND HYDRAULIC CONTROL VALVE

FROM MID ROTATIONAL RANGE TO HIGH ROTATIONAL RANGE

HIGH ROTATIONAL RANGE

FIRST HYDRAULIC CONTROL VALVE

SECOND HYDRAULIC CONTROL VALVE

ENGINE LUBRICATION CONTROL SYSTEM

BACKGROUND OF THE INVENTION

1. Field of the Invention

The present invention relates to an engine lubrication control system for adjusting the hydraulic pressure that is supplied to respective channels in a lubricating oil feeding device of an engine, or more particularly in a lubricating oil feeding device provided with a cam shaft supply channel for feeding lubricating oil to a cam journal or the like of a cylinder head, and a crank shaft supply channel for feeding lubricating oil to a crank shaft, a connecting rod or the like of a cylinder block.

2. Description of the Related Art

Conventionally, since oil that is needed by sliding parts of the engine such as a crank shaft and a cam shaft or cam shaft mechanical sections is supplied by an oil pump that is driven by the engine, the pressure of the oil that is supplied from the oil pump to the respective components of the engine will change substantially in proportion to the speed of the engine. Thus, depending on the engine speed, there are cases where the discharge pressure becomes greater than necessary, and there is a problem in that the friction of the oil pump increases more than necessary and unneeded work is thereby increased. In view of this, attempts are being made to achieve an appropriate discharge pressure in accordance with the engine speed.

As a lubrication control system for achieving the foregoing object, there is the type disclosed in, for example, Japanese Patent Application Publication No. 2009-264241. Japanese Patent Application Publication No. 2009-264241 is now briefly explained. The reference numerals used in the explanation are cited as is from Japanese Patent Application Publication No. 2009-264241. Foremost, oil is pumped up from an oil pan 10 by an oil pump 12, and fed to a first oil supply route 16*a* (lower route), and a second oil supply route 16*b* (upper route).

The first oil supply route 16*a* is mainly a route for supplying oil to a bearing 18 of the crank shaft, and the second oil supply route 16*b* is a route for supplying oil, for instance, to a valve gear 20. A hydraulic pressure control valve 22 for controlling the oil content to be supplied to the bearing 18 of the crank shaft is disposed above the first oil supply route 16*a*. The hydraulic pressure control valve 22 is configured so that its output hydraulic pressure is controlled by the control unit 24.

The control unit 24 is controlled by an engine speed sensor 26, an engine load sensor 28, an oil temperature sensor 30, and a hydraulic pressure sensor 32. Provided is a relief valve 34 which relieves the excessive hydraulic pressure from the oil route between the oil pump 12 and a filter 14 to the oil pan 10 when the hydraulic pressure exceeds a predetermined value. In the foregoing configuration, the hydraulic pressure control valve 22 is electronically controlled by the control unit 24.

SUMMARY OF THE INVENTION

In Japanese Patent Application Publication No. 2009-264241 and conventional technology comprising a similar configuration, the hydraulic pressure that is supplied to the cam shaft is controlled by the relief valve to be a substantially constant hydraulic pressure at a predetermined engine speed or higher. However, with this kind of configuration, the hydraulic pressure that is controlled by the relief valve needs to be a high pressure during the high rotation and high load of the engine so that the lubrication of the cam shaft will remain sufficient.

Thus, the hydraulic pressure that is supplied to the cam-shaft in a mid rotational range of the engine becomes the hydraulic pressure corresponding to the engine speed. Nevertheless, since the hydraulic pressure that is required in the cam shaft in a mid rotational range of the engine is generally lower than the hydraulic pressure corresponding to the engine speed, the oil pump will supply greater hydraulic pressure than necessary, and there is a problem in that it is not possible to reduce the friction of the oil pump.

Thus, as a result of intense study to overcome the foregoing problem, the present inventors discovered that it is possible to resolve the foregoing problem by causing the first aspect of the present invention to be an engine lubrication control system including an engine, an oil pump which is driven by the engine, an oil circuit which extends downstream from the oil pump, and a plurality of oil branch supply paths which branch from the oil circuit and supply oil to each part of the engine, wherein a hydraulically-driven first hydraulic control valve which controls, in a stepwise manner, a discharge pressure of the oil pump relative to a speed of the engine is disposed on the oil circuit, a hydraulically-driven second hydraulic control valve is disposed on at least one of the plurality of oil branch supply paths, and a downstream hydraulic pressure of the second hydraulic control valve is controlled to be lower than a downstream hydraulic pressure of the first hydraulic control valve of the oil circuit at least across a range of a predetermined engine speed.

The foregoing problem was additionally resolved by causing the second aspect of the present invention to be, in the first aspect, an engine lubrication control system in which the second hydraulic control valve is disposed on a crank shaft supply path or a cam shaft supply path among the plurality of oil branch supply paths. The foregoing problem was additionally resolved by causing the third aspect of the present invention to be, in the first aspect or the second aspect, an engine lubrication control system in which the downstream hydraulic pressure of the first hydraulic control valve of the oil circuit is controlled to be substantially the same as the downstream hydraulic pressure of the second hydraulic control valve, at an engine speed that is higher than the predetermined engine speed range.

The foregoing problem was additionally resolved by causing the fourth aspect of the present invention to be, in one aspect among the first to third aspects, an engine lubrication control system in which the engine speed when an operation the second hydraulic control valve is started is lower than the engine speed when an operation of the first hydraulic control valve is started.

The foregoing problem was additionally resolved by causing the fifth aspect of the present invention to be, in one aspect among the first to fourth aspects, an engine lubrication control system in which the second hydraulic control valve includes a channel cross-sectional area adjustment spool which changes a channel cross-sectional area of a main channel of the crank shaft supply path, and the channel cross-sectional area adjustment spool decreases the channel cross-sectional area of the main channel when a downstream hydraulic pressure of the channel cross-sectional area adjustment spool is greater than a predetermined hydraulic pressure value 1, and the channel cross-sectional area adjustment spool is restored such that the channel cross-sectional area of the main channel is maximized when a hydraulic pressure that is more upstream than the channel cross-sectional area adjustment spool is a predetermined hydraulic pressure value 2, which is greater than the predetermined hydraulic pressure value 1.

According to the first aspect of the present invention, in a predetermined engine speed range; for instance, in a mid rotational range, the hydraulic pressure that is supplied to the respective parts of the engine is controlled, by the first hydraulic control valve, to be lower than the discharge pressure of the oil pump which is substantially proportionate to the engine speed. Moreover, while the hydraulic pressure that is needed in the respective parts of the engine differs for each part, the second hydraulic control valve disposed on the oil branch supply path can further decrease the hydraulic pressure of parts in which their functions can be satisfied even with a low hydraulic pressure.

Consequently, in a predetermined engine speed range, by not disposing the second hydraulic control valve to portions that require a relatively high hydraulic pressure, and disposing the second hydraulic control valve to portions in which their functions can be satisfied even with a low hydraulic pressure to achieve a low hydraulic pressure, an appropriate hydraulic pressure can be distributed to the respective parts of the engine.

Moreover, since the minimum required hydraulic pressure can be supplied to the respective parts of the engine, the work of the oil pump can be minimized, and this will contribute to the improvement in efficiency. In addition, since the hydraulically-driven second hydraulic control valve is driven in conjunction with the change in the hydraulic pressure of the electronically-controlled first hydraulic control valve capable of performing accurate control, accurate control can also be performed by the hydraulically-driven second hydraulic control valve which is easily influenced by disturbance such as the oil temperature.

The second aspect of the present invention yields substantially the same effect as first aspect. Moreover, since bearings of the crank shaft and cam shaft or the like are subject to considerably reduced sliding resistance based on the decreased hydraulic pressure due to the operation of the second hydraulic control valve, fuel efficiency can be improved.

According to the third aspect of the present invention, by raising the downstream hydraulic pressure of the second hydraulic control valve, which is of a low hydraulic pressure, to be substantially the same as the downstream hydraulic pressure of the first hydraulic control valve, sufficient lubrication and cooling can be performed even when the engine is in a state of high rotation and high load.

According to the fourth aspect of the present invention, by causing the second hydraulic control valve to start its operation at a lower engine speed, the oil groove of the oil branch supply path on which the second hydraulic control valve is disposed becomes constricted. Consequently, since more oil will flow to other oil branch supply paths, the hydraulic pressure of the oil flowing through the other oil branch supply paths will increase.

If a variable valve timing mechanism or a device which operates at a predetermined hydraulic pressure of an oil jet or the like is disposed on the other oil branch supply paths, the hydraulic pressure required for that device can be secured from the low rotation side, and the range of the engine speed in which the device will operate can be expanded.

According to the fifth aspect of the present invention, since the second hydraulic control valve contracts and restores (expands) the channel cross-sectional area of the main channel by directly using the upstream and downstream hydraulic pressures of the channel cross-sectional area adjustment spool, the operation of the channel cross-sectional area adjustment spool becomes accurate and highly responsive, and the friction of the oil pump can be decreased without impairing the lubrication of the crank shaft.

BRIEF DESCRIPTION OF THE DRAWINGS

FIG. 1A is a configuration diagram of the engine lubrication control system of the present invention, FIG. 1B is a schematic diagram of the configuration of the second hydraulic control valve of FIG. 1A, and FIG. 1C is a schematic diagram of the configuration of the first hydraulic control valve (electronically controlled 2-stage relief valve) of FIG. 1A;

DESCRIPTION OF THE PREFERRED EMBODIMENTS

Figure 2:
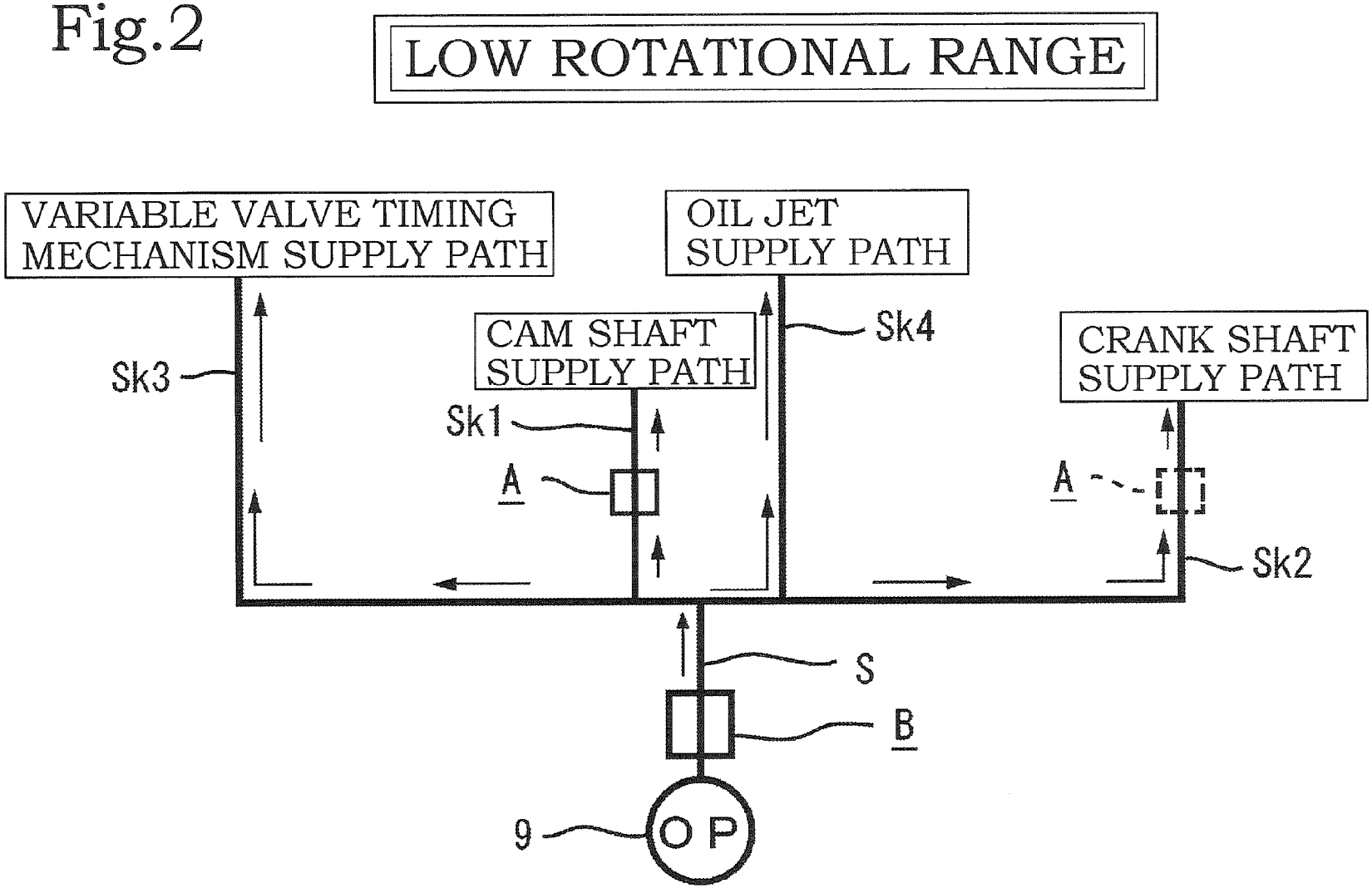
FIG. 2 is a schematic diagram showing the state of the oil in a low rotational range of the engine lubrication control system in the present invention.

Embodiments of the present invention are now explained with reference to the drawings. In the control system of the present invention, the circuit through which oil flows is configured from one oil circuit S, and a plurality of oil branch supply paths Sk (refer to FIG. 1A, FIG. 2 to FIG. 4). The oil circuit S is positioned upstream, and the oil branch supply paths Sk are positioned downstream. The circuit includes a plurality of oil branch supply paths Sk which branch from the oil circuit S and supply oil to each part of the engine.

In addition, the plurality of oil branch supply paths Sk specifically include a cam shaft supply path Sk1 and a crank shaft supply path Sk2 which supply oil on the downstream side of the oil pump 9, and are also sometimes provided with a variable valve timing mechanism supply path Sk3, or an oil jet supply path Sk4 which sprays oil to the lower face of the piston of the engine.

In the oil branch supply path Sk, the crank shaft supply path Sk2 is mainly used for feeding oil to the bearings of the crank shaft or the like in a lower area of the engine, and the cam shaft supply path Sk1 is a path for feeding oil to the valve gear of the engine and the like.

The oil circuit S is provided with a first hydraulic control valve B. Moreover, at least one of the plurality of oil branch supply paths Sk is provided with a second hydraulic control valve A. In other words, the second hydraulic control valve A is provided to several or all of the plurality of oil branch supply paths Sk.

The second hydraulic control valve A controls the hydraulic pressure of the oil branch supply path Sk to be lower than the hydraulic pressure controlled by the first hydraulic control valve B across a predetermined engine speed range. A configuration where the second hydraulic control valve A is provided only to the cam shaft supply path Sk1 and the crank shaft supply path Sk2 of the oil branch supply path Sk is explained below.

In the present invention, the oil pump 9 is a mechanically-driven oil pump 9. Note that the illustration of the engine is omitted. As a specific example of the second hydraulic control valve A, the second hydraulic control valve A is provided to the crank shaft supply path S2 on the oil branch supply path Sk, and the first hydraulic control valve (2-stage relief valve) B is provided to the cam shaft supply path S1. In addition, the second hydraulic control valve A is disposed more downstream than the first hydraulic control valve B (2-stage relief valve) with the position of the oil pump 9 as the reference.

The second hydraulic control valve A is configured from a housing not shown, a channel cross-sectional area adjustment spool 41, a channel on/off valve 42, a channel on/off spool 43, and elastic members 45, 46, 47 that elastically bias the foregoing valves. A main channel 11 is formed in the housing. The main channel 11 configures a part of the oil branch supply paths Sk.

Formed in the housing are a channel cross-sectional area adjustment spool chamber 21, a channel on/off valve chamber 22 and a channel on/off spool chamber 23. The channel cross-sectional area adjustment spool chamber 21 is formed at substantially the center portion of the main channel 11, and more specifically is a room that is formed to intersect, in an orthogonal state, the middle portion of the main channel 11, and is separated into two rooms by the main channel 11. Mounted on the channel cross-sectional area adjustment spool chamber 21 is the channel cross-sectional area adjustment spool 41 described later.

Moreover, a downstream branch channel 12 is formed at a location that is positioned more downstream than the position of the channel cross-sectional area adjustment spool chamber 21 in the main channel 11, and an upstream branch channel 13 is formed more upstream than the channel cross-sectional area adjustment spool chamber 21.

The channel on/off valve chamber 22 is in communication with the downstream side of the main channel 11 via the downstream branch channel 12. Moreover, the channel on/off spool chamber 23 is in communication with the upstream side of the main channel 11 via the upstream branch channel 13. Specifically, the downstream branch channel 12 is in communication with an apex opening 22*a* of the channel on/off valve chamber 22 in the axial direction, and the upstream branch channel 13 is in communication with an apex opening 23*a* formed at the apex of the channel on/off spool chamber 23 in the axial direction.

A communication channel 3 is formed between the channel on/off valve chamber 22 and the channel cross-sectional area adjustment spool chamber 21, and the channel on/off valve chamber 22 and the channel cross-sectional area adjustment spool chamber 21 are in communication via the communication channel 3. The channel on/off spool chamber 23 is disposed at the middle portion of the communication channel 3. That is, the communication channel 3 is configured to be separated into two by the channel on/off spool chamber 23.

In addition, with the communication channel 3, the channel between the channel on/off valve chamber 22 and the channel on/off spool chamber 23 is referred to as a first communication channel 31, and the channel between the channel on/off spool chamber 23 and the channel cross-sectional area adjustment spool chamber 21 is referred to as a second communication channel 32. One end of the first communication channel 31 is in communication with a lateral outlet 22*b* formed on a lateral face that is orthogonal to the channel on/off valve chamber 22 in the axial direction.

Moreover, the other end of the first communication channel 31 is in communication with a lateral inlet 23*b* formed on a lateral face that is orthogonal to the channel on/off spool chamber 23 in the axial direction. In addition, one end of the second communication channel 32 is in communication with a lateral outlet 23*c* formed on a lateral face that is orthogonal to the channel on/off spool chamber 23 in the axial direction. Moreover, the other end of the second communication channel 32 is in communication with an apex inlet 21*a* formed at the apex of the channel cross-sectional area adjustment spool chamber 21 in the axial direction.

In addition, a drain channel 33 is formed, in a communicating manner, between the channel on/off spool chamber 23 and the channel cross-sectional area adjustment spool chamber 21 at a position along the axial direction that is different from the second communication channel 32. Specifically, an apex outlet 21*b* is formed at a position that is different from the apex inlet 21*a* at the apex of the channel cross-sectional area adjustment spool chamber 21, a drain inlet 23*d* is formed at a position that is lower than the lateral outlet 23*c* in the axial direction one a lateral face that is orthogonal to the channel on/off spool chamber 23 in the axial direction, and the drain channel 33 is formed between the apex outlet 21*b* and the drain inlet 23*d*.

Moreover, a drain outlet 23*e* is formed on the channel on/off spool chamber 23 at a position that is the same as the drain inlet 23*d* in the axial direction but different in the peripheral direction, and a discharge channel 34 which communicates with the outside of the housing is formed from the drain outlet 23*e*.

Mounted on the channel cross-sectional area adjustment spool chamber 21 is the channel cross-sectional area adjustment spool 41. The channel cross-sectional area adjustment spool 41 is mounted on the channel cross-sectional area adjustment spool chamber 21 slidably in the axial direction and so as to cut across the main channel 11 in a substantially orthogonal state. In addition, the channel cross-sectional area adjustment spool 41 functions to control the flow rate and pressure of the oil flowing in the main channel 11 by sliding in the axial direction and constricting the channel cross-sectional area of the main channel 11.

The channel cross-sectional area adjustment spool 41 is configured from a first sliding part 411 that is inserted into the main chamber part 211, a second sliding part 412 that is inserted into the sub chamber part 212, a constricted part 41*b* that communicates the first sliding part 411 and the second sliding part 412, and a large diameter flange-shaped part 41*d*. The outer diameter of the first sliding part 411 and the second sliding part 412 is formed to be substantially equal to or slightly smaller than the inner diameter of the main channel 11.

The constricted part 41*b* is formed to be smaller than the outer diameter of the first sliding part 411 and the second sliding part 412. Moreover, the large diameter flange-shaped part 41*d* is formed at the end of the first sliding part 411 and formed to be larger than the outer diameter of the first sliding part 411. The periphery of the constricted part 41*b* is an opening area 41*c*.

The channel cross-sectional area adjustment spool 41 is normally subject to the elastic biasing force of the elastic member 45 so that the constricted part 41*b* cuts across within the main channel 11 and the channel cross-sectional area of the main channel 11 is fully opened to maximum. As an embodiment of the elastic member 45, a coil spring is mainly used. Moreover, a fully opened state of the main channel 11 refers to a state where only the constricted part 41*b* of the channel cross-sectional area adjustment spool 41 cuts across within the main channel 11, and a state where the oil flows to the opening area 41*c*.

In addition, as a result of oil flowing from the apex inlet 21*a* of the channel cross-sectional area adjustment spool chamber 21, the large diameter flange-shaped part 41*d* of the channel cross-sectional area adjustment spool 41 is pressed by the pressure from the oil flowing through the communication channel 3, and the channel cross-sectional area adjustment spool 41 slides in the axial direction against the elastic biasing force of the elastic member 45.

Figure 7A:
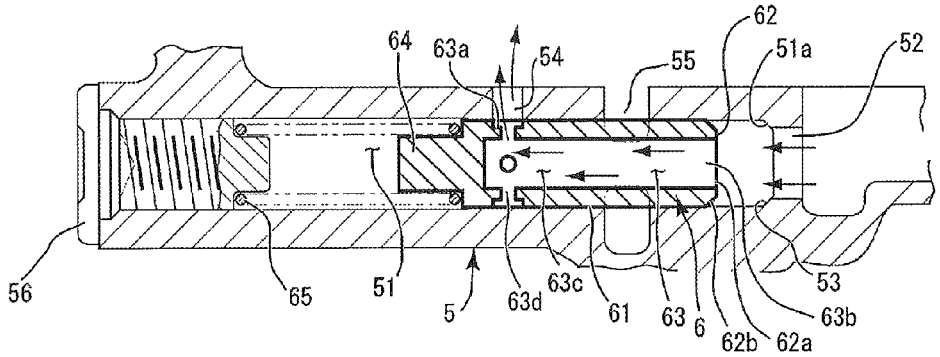
FIG. 7A is a schematic diagram showing the operating state of the first hydraulic control valve (2-stage relief valve) in a mid rotational range.
Figure 7B:
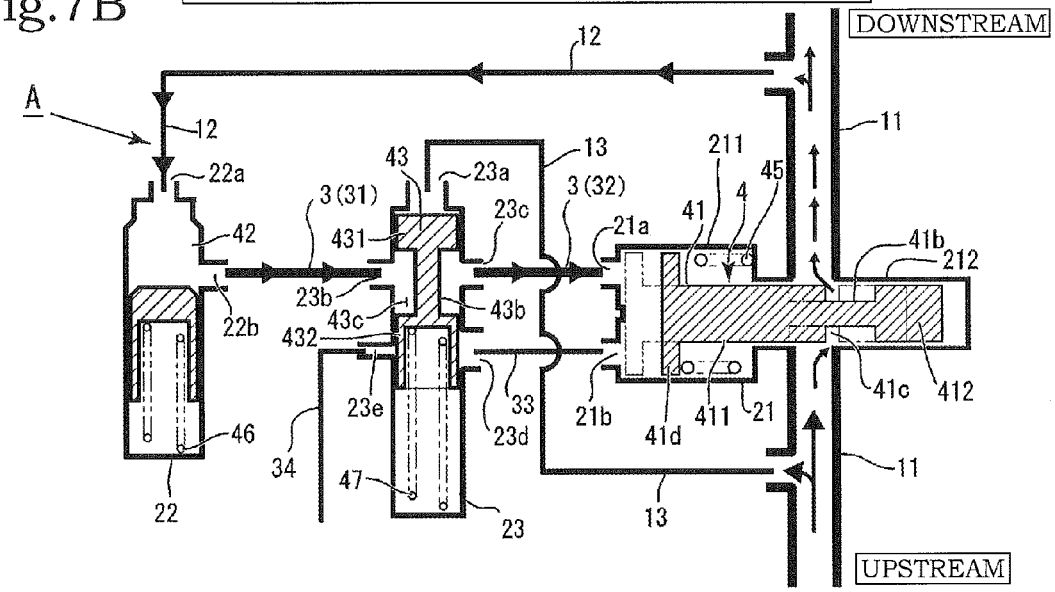
FIG. 7B is an operating state diagram of the second hydraulic control valve in a mid rotational range.

Consequently, the protrusion of the constricted part 41*b* will decrease while the protrusion of the first sliding part 411 will increase in the main channel 11, the channel cross-sectional area of the main channel 11 is contracted from a fully open state, and the cross-sectional area of the main channel 11 is constructed and the flow rate and pressure of the oil will decrease (refer to FIG. 7B). Moreover, the first sliding part 411 is used for contracting the channel cross-sectional area of the main channel 11, and is not used for completely blocking the flow of oil, and reduces the flow rate and pressure of the oil.

Moreover, a channel on/off valve 42 is mounted on the channel on/off valve chamber 22. The channel on/off valve 42 functions as an on/off valve for blocking and communicating the downstream branch channel 12 and the first communication channel 31 configuring the communication channel 3. In addition, the channel on/off valve 42 is normally pressed toward the apex of the channel on/off valve chamber 22 in the axial direction by the elastic biasing force of the elastic member 46, and is positioned at the apex of the channel on/off valve chamber 22.

This state shall be the initial state of the channel on/off valve 42. The channel on/off valve 42 is blocking the downstream branch channel 12 and the first communication channel 31 in a state of being positioned at the apex of the channel on/off valve chamber 22; that is, in the initial state.

A channel on/off spool 43 is disposed on the channel on/off spool chamber 23. The channel on/off spool 43 functions to communication and block the first communication channel 31 and the second communication channel 32 configuring the communication channel 3. The channel on/off spool 43 is configured from a first sliding part 431, a second sliding part 432 and a constricted part 43*b* that connects the first sliding part 431 and the second sliding part 432 and has a diameter that is smaller than the outer diameter of the first sliding part 431 and the second sliding part 432. An opening area 43*c* is formed with the constricted part 43*b* and the inner wall of the channel on/off spool chamber 23.

The channel on/off spool 43 is normally pressed toward the apex of the channel on/off spool chamber 23 by the elastic biasing force of the elastic member 47, and is positioned at the apex of the channel on/off spool chamber 23. This state shall be the initial state of the channel on/off spool 43. The elastic member 46 and the elastic member 47 are mainly configured from coil springs.

The constricted part 43*b* is positioned at the lateral inlet 23*b* and the lateral outlet 23*c* when the channel on/off spool 43 is in a state of being positioned at the apex of the channel on/off spool chamber 23; that is, in the initial state, and the lateral inlet 23*b* and the lateral outlet 23*c* are released via the opening area 43*c*, and the first communication channel 31 and the second communication channel 32 are in communication.

In addition, as a result of oil flowing to the upstream branch channel 13, which is in communication with the channel on/off spool chamber 23 at the apex, and the oil pressure increasing, the channel on/off spool 43 slides against the elastic biasing force of the elastic member 47, the first sliding part 431 reaches and closes the position of the lateral inlet 23*b* and the lateral outlet 23*c*, and blocks the first communication channel 31 and the second communication channel 32.

When the channel on/off spool 43 slides by the pressure of the oil flowing through the upstream branch channel 13, the first and second sliding parts 431, 432 of the channel on/off spool 43 block the lateral inlet 23*b* and the lateral outlet 23*c* of the channel on/off spool chamber 23, and block the communicating state of the first communication channel 31 and the second communication channel 32. In addition, the flow of oil from the communication channel 3 to the channel cross-sectional area adjustment spool chamber 21 is stopped.

The channel cross-sectional area adjustment spool 41 is mounted on the channel cross-sectional area adjustment spool chamber 21 slidably in the axial direction and so as to cut across the main channel 11 in a substantially orthogonal state. The diameter of the first sliding part 411 (and the second sliding part 412) of the channel cross-sectional area adjustment spool 41 is formed to be substantially equal to the inner diameter of the main channel 11. In addition, as a result of the channel cross-sectional area adjustment spool 41 sliding in the axial direction, the protrusion of the constricted part 41*b* and the protrusion of the first sliding part 411 are increased/decreased in the main channel 11, and the channel cross-sectional area of the main channel 11 is consequently contracted from a fully opened state.

The channel cross-sectional area adjustment spool 41 is normally subject to the elastic biasing force of the elastic member 45 so that the constricted part 41*b* cuts across within the main channel 11 and the channel cross-sectional area of the main channel 11 is fully opened to maximum. In addition, as a result of oil flowing into the channel cross-sectional area adjustment spool chamber 21, the large diameter flange-shaped part 41*d* of the channel cross-sectional area adjustment spool 41 is pressed, and slides against the elastic biasing force of the elastic member 45.

Figure 6A:
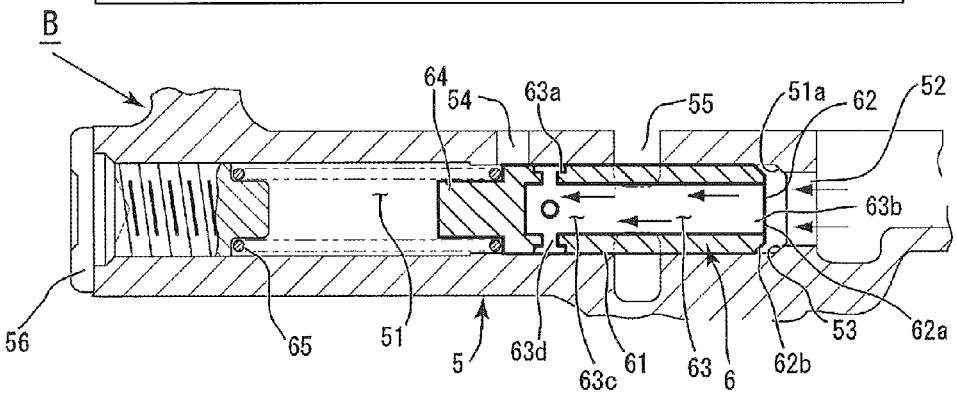
FIG. 6A is a schematic diagram showing the operating state of the first hydraulic control valve (2-stage relief valve) in a low rotational range.
Figure 6B:
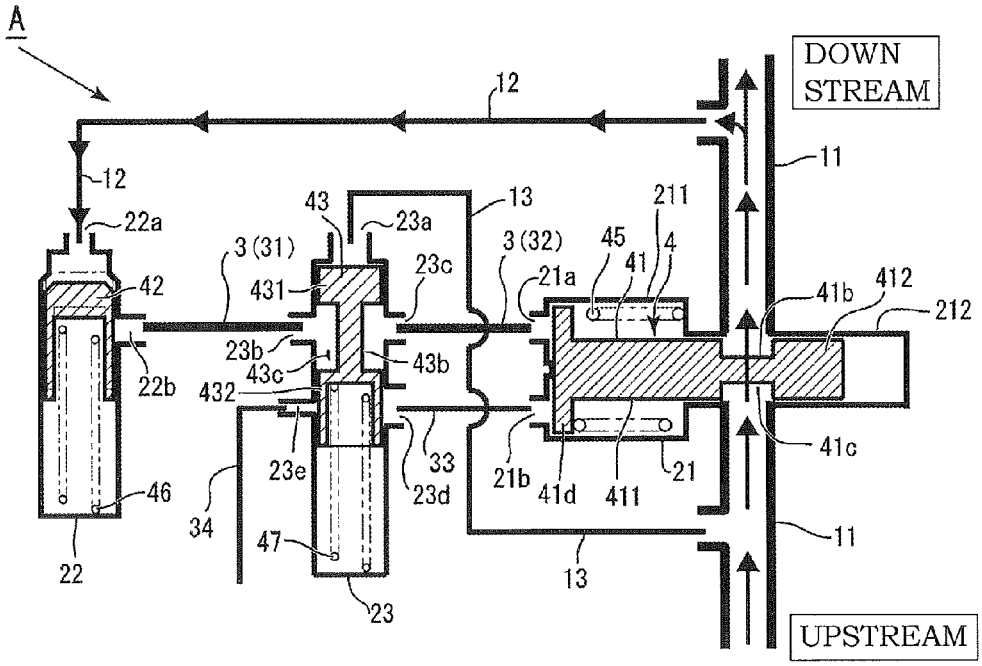
FIG. 6B is an operating state diagram of the second hydraulic control valve in a low rotational range.

With the second hydraulic control valve A, in a low rotational range of the engine, the channel cross-sectional area adjustment spool 41 is in its initial state by the elastic member 45, the constricted part 41*b* is in a fully open state in a state of cutting across the main channel 11, and the entire amount of the oil passes through the opening area 41*c* around the constricted part 41*b* of the channel cross-sectional area adjustment spool 41 and flows from the upstream side to the downstream side (refer to FIG. 6B).

In a low rotational range of the engine, the oil flowing through the main channel 11 may flow into the downstream branch channel 12 and the upstream branch channel 13, but the channel on/off valve 42 and the channel on/off spool 43 will never engage in an on/off operation. Accordingly, there is no particular change in the hydraulic pressure, and the upper hydraulic pressure and the lower hydraulic pressure are substantially equal.

Subsequently, in a mid rotational range of the engine, the pressure of oil flowing from the main channel 11 to the downstream branch channel 12 will increase (refer to FIG. 7B). In addition, pursuant to the increase of pressure, the channel on/off valve 42 is pressed against the elastic biasing force of the elastically biasing elastic member 46, and causes the channel on/off valve chamber 22 to slide. Consequently, the apex opening 22*a* and the lateral outlet 22*b* of the channel on/off valve chamber 22 are released, and the downstream branch channel 12 and the first communication channel 31 of the communication channel 3 are in communication.

Moreover, while the oil flowing through the main channel 11 also flows through the upstream branch channel 13, the force from the hydraulic pressure on the upstream side in a mid rotational range is smaller than the elastic biasing force of the elastic member 47 that elastically biases the channel on/off spool 43, and is maintained to be substantially immovable. In this state, the channel on/off spool chamber 43 is maintained in a substantial initial state, the constricted part 43*b* of the channel on/off spool 43 is positioned at the lateral inlet 23*b* and the lateral outlet 23*c* of the channel on/off spool chamber 23, and the lateral inlet 23*b* and the lateral outlet 23*c* are of an open state.

Consequently, the downstream branch channel 12, the first communication channel 31, and the second communication channel 32 are in communication, and, through the downstream branch channel 12 and the communication channel 3 (first communication channel 31, second communication channel 32), oil flows from the apex inlet 21*a* of the channel cross-sectional area adjustment spool chamber 21 (refer to FIG. 7B). Moreover, in the foregoing case, the drain inlet 23*d* and the drain outlet 23*e* of the channel on/off spool chamber 23 are closed by the second sliding part 432 of the channel on/off spool 43 (refer to FIG. 7B).

Accordingly, with the channel cross-sectional area adjustment spool chamber 21, oil will not flow out from the apex outlet 21*b*. Consequently, the channel cross-sectional area adjustment spool 41 slides against the elastic biasing force of the elastic member 45. In addition, with the channel cross-sectional area adjustment spool 41, the portion that cuts across the main channel 11 changes from the constricted part 41*b* to the first sliding part 411, and the channel cross-sectional area of the main channel 11 is reduced (refer to FIG. 7B).

In other words, as a result of the channel cross-sectional area adjustment spool 41 sliding, the first sliding part 411 contracts the channel cross-sectional area of the main channel 11 and functions as an orifice. Accordingly, the flow rate and pressure of the oil flowing from the upstream side to the downstream side of the main channel 11 will decrease. However, the flow of oil is not completely stopped, and is only reduced, and a slight flow is maintained. Thus, as a result of the channel cross-sectional area of the main channel 11 decreasing, the hydraulic pressure will be lower in the downstream pressure (lower hydraulic pressure) of the control valve than the upstream pressure (equivalent to upper hydraulic pressure) of the control valve.

Figure 8A:
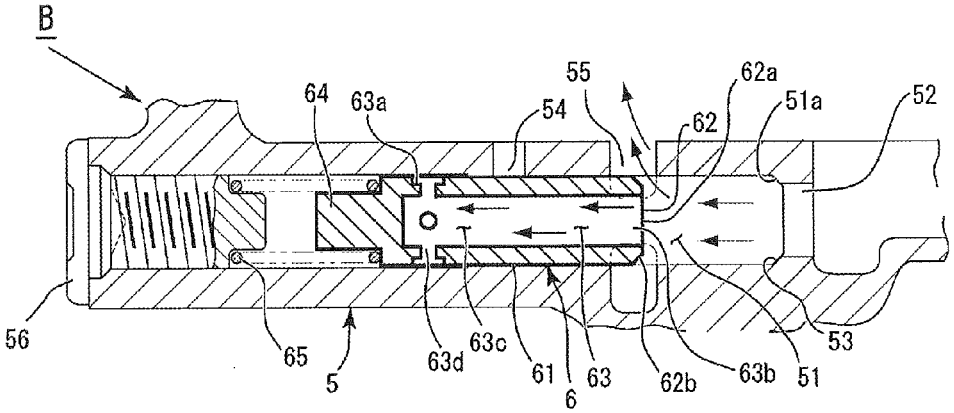
FIG. 8A is a schematic diagram showing the operating state of the first hydraulic control valve (2-stage relief valve) in a high rotational range.
Figure 8B:
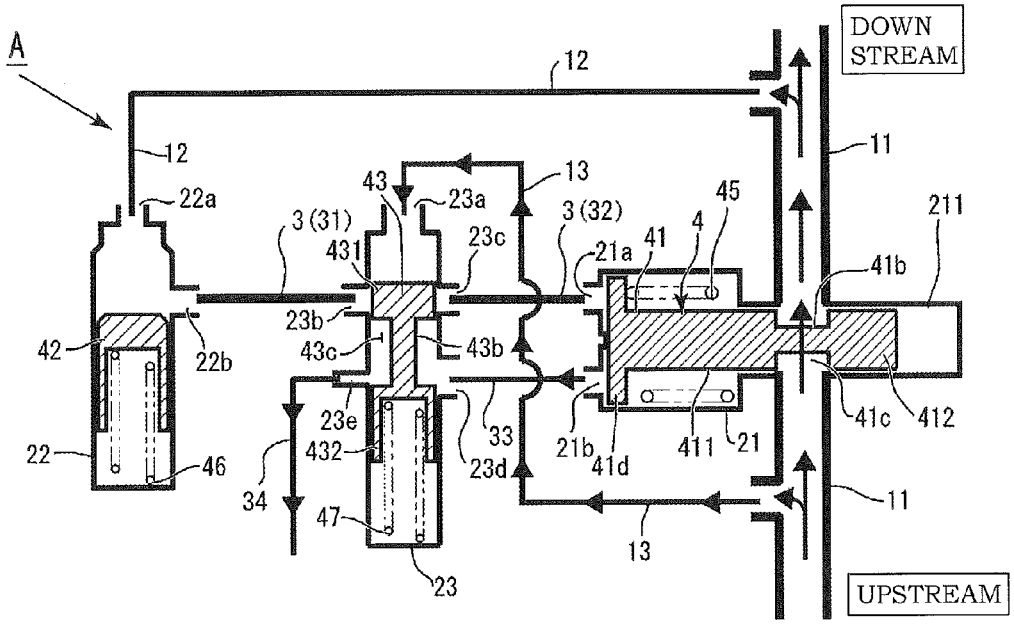
FIG. 8B is an operating state diagram of the second hydraulic control valve in a high rotational range.

Subsequent, in a high rotational range of the engine, the pressure of oil on the upstream side of the main channel 11 will rise, and the pressure of oil flowing from the main channel 11 to the upstream branch channel 13 will also rise (refer to FIG. 8B). Consequently, the force from the pressure of oil flowing from the apex opening 23*a* of the channel on/off spool chamber 23 causes the channel on/off spool 43 to slide against the elastic biasing force of the elastic member 47 which elastically biases the channel on/off spool 43.

In addition, the first sliding part 431 of the channel on/off spool 43 blocks the lateral inlet 23*b* and the lateral outlet 23*c* of the channel on/off spool chamber 23, and the constricted part 43*b* simultaneously reaches the position of the drain inlet 23*d* and the drain outlet 23*e* and releases the drain inlet 23*d* and the drain outlet 23*e*.

Consequently, the channel cross-sectional area adjustment spool 41 is pressed by the elastic biasing force of the elastic member 45, and the oil accumulated in the channel cross-sectional area adjustment spool chamber 21 flows from the apex outlet 21*b* through the drain channel 33, flows through the drain inlet 23*d* and the drain outlet 23*e* of the channel on/off spool chamber 23, and is discharged from the discharge channel 34 to the outside of the housing. The channel cross-sectional area adjustment spool 41 thereby smoothly returns to its initial position.

The first hydraulic control valve (2-stage relief valve) B is now explained. The first hydraulic control valve (2-stage relief valve) B is a device that operates only by hydraulic pressure, and does not include any electrically controlled structure. The 2-stage relief valve B is mainly configured from a valve housing 5 and a valve body 6.

A valve passage 51 for sliding the valve body 6 is formed inside the valve housing 5, and the valve body 6 slides through the valve passage 51. A relief inflow part 52, into which flows the oil discharged from the oil pump 9, is formed at the end of valve housing 5 in an axial direction, and the relief inflow part 52 and the valve passage 51 are in communication (refer to FIG. 10, FIG. 6A and so on).

A stepped part is formed between the valve passage 51 and the relief inflow part 52, and the stepped part becomes a relief inflow blocking surface 53. The boundary of the relief inflow part 52 and the valve passage 51 is a so-called starting end 51*a* of the valve passage 51, and, with the valve passage 51 as the reference position, a state where a valve head 62 of the valve body 6 comes into contact with the relief inflow blocking surface 53 is the initial state of the valve body 6.

A first discharge part 54 and a second discharge part 55 are formed at respectively different positions, in the axial direction, at substantially the intermediate position of the valve housing 5 in the axial direction. The second discharge part 55 is formed more on the side of the relief inflow part 52 than the first discharge part 54 (refer to FIG. 10, FIG. 6A).

The first discharge part 54 is a through-hole which communicates the inside and outside of the valve housing 5. The second discharge part 55 is formed at a position that is more on the side of the relief inflow part 52 than the first discharge part 54 in the passage direction of the valve passage 51.

The valve body 6 is configured from an outer peripheral lateral part 61 and a valve head 62, and, with the valve head 62, a slope 62*b* is formed at the outer peripheral edge of a vertex 62*a*. The valve body 6 housed in the valve housing 5 is constantly elastically biased toward the relief inflow part 52 of the valve passage 51 with a spring 65 mounted on the valve passage 51, and the valve head 62 of the valve body 6 comes into contact with the relief inflow blocking surface 53 of the valve passage 51.

A substantial head-cut conical shape is formed with the vertex 62*a* and the slope 62*b*. A valve channel 63 is formed about the axis extending from the vertex 62*a* of the valve head 62 to the outer peripheral lateral part 61. With regard to the valve channel 63, a horizontal channel 63*c* is formed inside the valve body 6 along the axial direction from the valve head 62, and a vertical channel 63*d*, which is orthogonal to the horizontal channel 63*c*, is formed around the horizontal channel 63*c* (refer to FIG. 6A and so on).

In addition, the horizontal channel 63*c* is in communication with a head opening 63*b* formed on the valve head 62 and the vertical channel 63*d* is in communication with an outer peripheral lateral opening 63*a* of the outer peripheral lateral part 61, and, with this kind of configuration, the head opening 63*b* and the outer peripheral lateral opening 63*a* are also in communication. The outer peripheral lateral opening 63*a* is formed in the outer peripheral lateral part 61 as an outer peripheral groove along the peripheral direction of the outer peripheral lateral part 61.

The oil that is fed through the horizontal channel 63*c* and the vertical channel 63*d* flows out to the outer peripheral lateral opening 63*a*, which is formed as the outer peripheral groove, and the valve body 6 slides within the valve passage 51, and the oil is fed to the first discharge part 54 in a state where the outer peripheral lateral opening 63*a* is in communication with the first discharge part 54. With the spring 65, one end thereof in the longitudinal direction is mounted on a spring support shaft 64 at the rear side of the valve body 6, and the other end thereof is fixed by a holding member 56 mounted on the valve passage 51. The outer peripheral lateral opening 63*a* of the valve body 6 is in communication with the valve channel 63 and the first discharge part 54 in a state of having reached the position of the first discharge part 54 formed in the valve housing 5.

As described above, the second discharge part 55 is formed at a position that is more on the side of the relief inflow part 52 than the first discharge part 54. In addition, in the initial state where the valve head 62 of the valve body 6 is in contact with the relief inflow blocking surface 53, the second discharge part 55 is formed at a position that is more on the side of the relief inflow part 52 than the outer peripheral lateral opening 63*a* of the valve body 6.

Accordingly, the outer peripheral lateral opening 63*a* of the valve body 6 is structured such that the outer peripheral lateral opening 63*a* communicates only with the first discharge part 54, and does not communicate with the second discharge part 55, as a result of the valve body 6 sliding within the valve passage 51.

In addition, the valve body 6 is configured to slide by the hydraulic pressure of the oil that flows in from the relief inflow part 52 from the initial state, and, after the outer peripheral lateral opening 63*a* communicates with the first discharge part 54, the valve head 62 of the valve body 6 passes through the second discharge part 55. Moreover, oil is never discharged simultaneously from the first discharge part 54 and the second discharge part 55.

With regard to the relief operation of the first hydraulic control valve B, in a low rotational range of the engine, both the first discharge part 54 and the second discharge part 55 are closed, and the oil is not relieved (refer to FIG. 6A). Thus, the hydraulic pressure rises substantially proportionate to the engine speed.

Figure 7C:
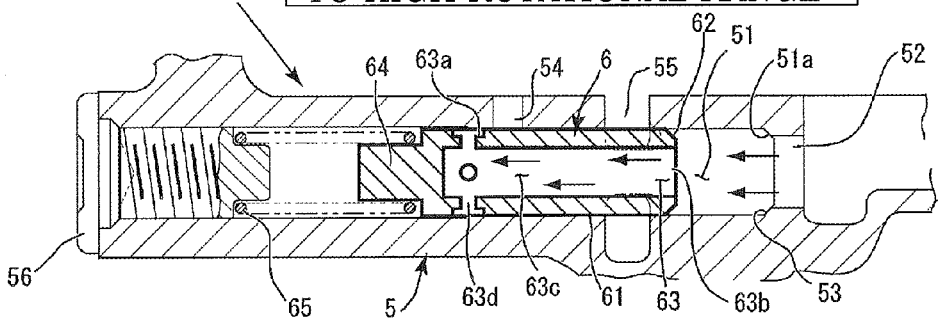
FIG. 7C is a schematic diagram showing the operating state of the first hydraulic control valve (2-stage relief valve) from a mid rotational range to a high rotational range.

In a mid rotational range of the engine, the first discharge part 54 and the outer peripheral lateral opening 63*a* are in communication, and the oil is relieved (refer to FIG. 7A). Thus, the rise in hydraulic pressure relative to the engine speed becomes moderate. Moreover, in a mid to high rotational range (transition range) of the engine, both the first discharge part 54 and the second discharge part 55 are closed, and the oil is not relieved (refer to FIG. 7C). Thus, the hydraulic pressure suddenly rises in the transition range.

In a high rotational range of the engine, the valve head 62 moves more toward the back side than the second discharge part 55, and the oil is relieved from the second discharge part 55 (refer to FIG. 8A). Thus, the rise in hydraulic pressure relative to the engine speed becomes moderate.

The operation of the engine lubrication control system of the present invention is now explained. Note that idling (also referred to as an idle rotation) is also included in the rotating state of the engine. In an idling range, the vehicle is stopped and a traction load is not applied to the engine, but in a low rotational range to a high rotational range, a load is applied to the engine since the vehicle is running. Moreover, as the basic motion, the second hydraulic control valve A controls the hydraulic pressure of the cam shaft supply path Sk1 and the crank shaft supply path Sk2 to be lower than the hydraulic pressure that is controlled by the first hydraulic control valve B across a range of a predetermined engine speed.

Figure 3:
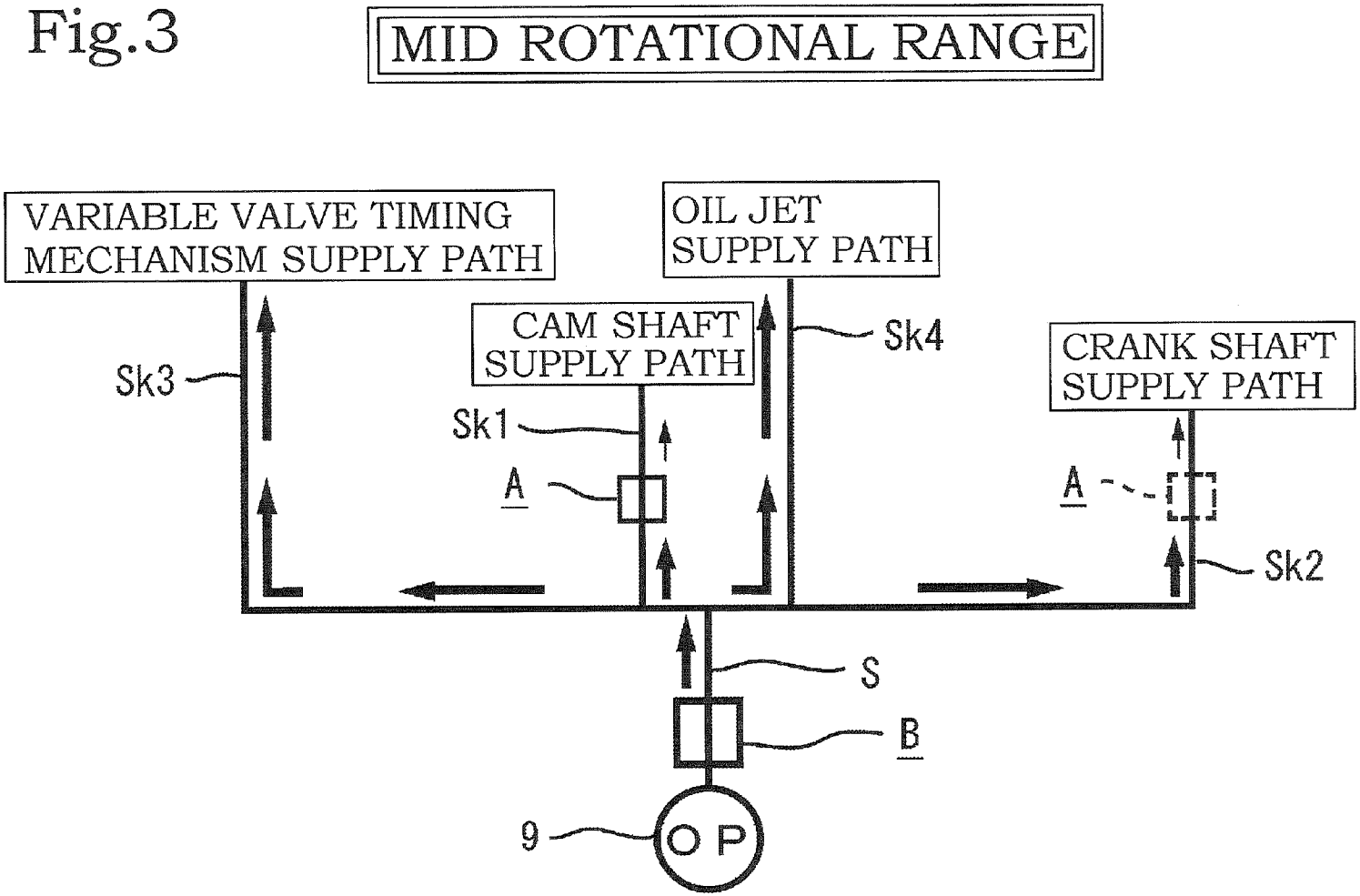
FIG. 3 is a schematic diagram showing the state of the oil in a mid rotational range of the engine lubrication control system in the present invention.
Figure 4:
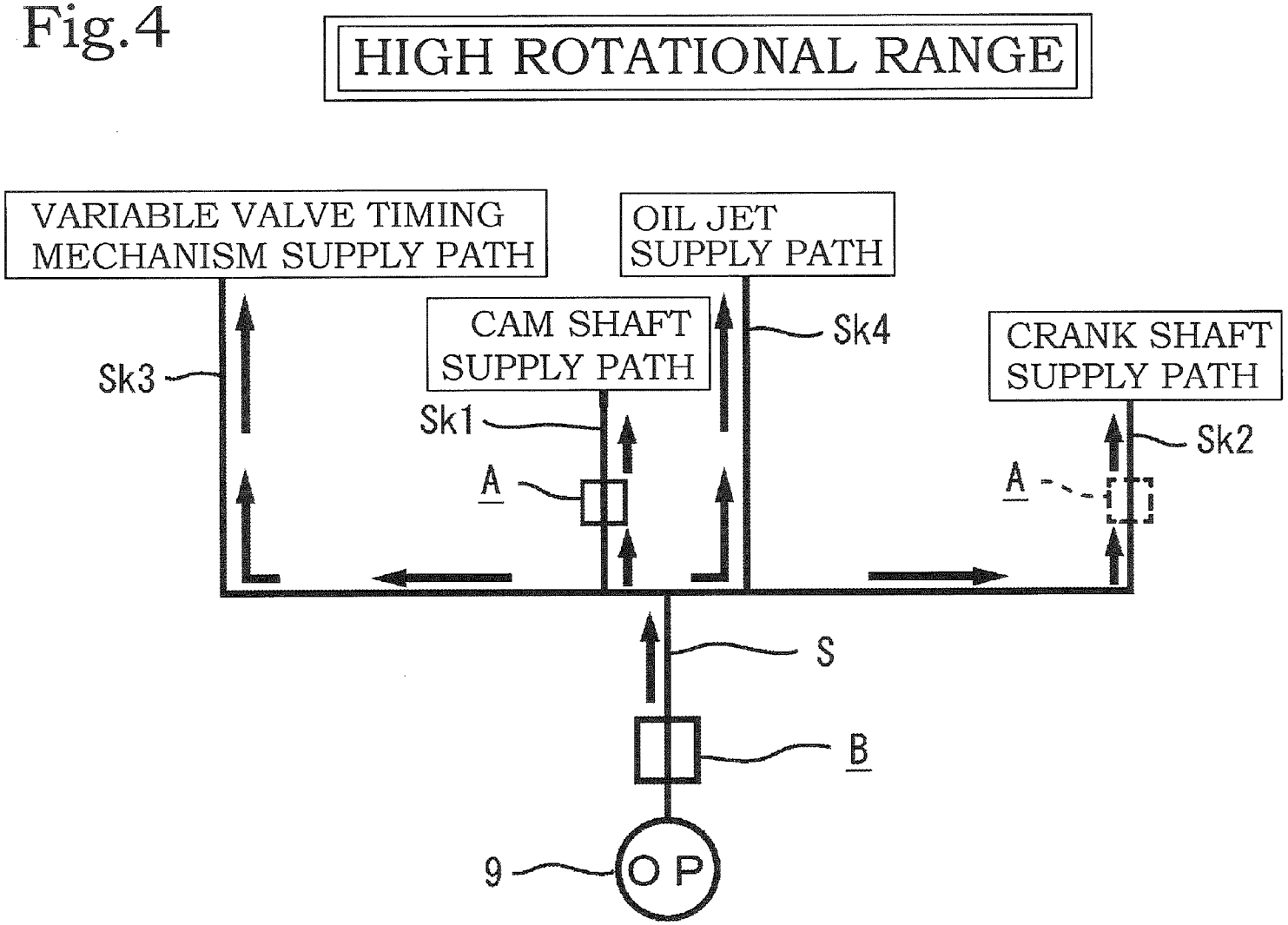
FIG. 4 is a schematic diagram showing the state of the oil in a high rotational range of the engine lubrication control system in the present invention.

Foremost, in a low rotational range of the engine, both the first hydraulic control valve B and the second hydraulic control valve A are not operated, and the entire amount of the oil is fed to the cam shaft supply path S1 and the crank shaft supply path S2 (refer to FIG. 2, FIG. 6). In FIG. 2 to FIG. 4, the arrow shows the flow of oil, and the thickness of the line in the arrow indicates the size of the flow rate.

Moreover, in a low rotational range of the engine, the configuration may also be such that the second hydraulic control valve A is operated from an engine speed that is lower than the minimum engine speed in a predetermined engine speed range. According to this kind of configuration, by constricting the crank shaft supply path Sk2 and the cam shaft supply path Sk1, more oil will flow to the other oil branch supply paths Sk (variable valve timing mechanism supply path Sk3, oil jet supply path Sk4).

Thus, the hydraulic pressure of the variable valve timing mechanism supply path Sk3, oil jet supply path Sk4 is controlled to be a higher pressure than the hydraulic pressure corresponding to the engine speed. Thus, the hydraulic pressure that is needed in a hydraulic transmission such as a variable valve timing mechanism can be secured from a lower rotation side, and the range of the engine speed in which the hydraulic transmission will operate can be expanded.

Subsequently, in a mid rotational range of the engine, the second hydraulic control valve A is operated (at a lower speed) prior to the first hydraulic control valve B (refer to FIG. 3, FIG. 7). Accordingly, in the flow of oil from upstream to downstream in the second hydraulic control valve A, the flow rate thereof will decrease, and the downstream pressure will become substantially constant without increasing. In addition, the supply of oil to the crank shaft supply path S2 will decrease, and the increase of pressure is inhibited.

Meanwhile, with the first hydraulic control valve B, while the flow rate and pressure of the oil will decrease in a mid rotational range, since the second hydraulic control valve A is operating in advance, the flow of oil to the cam shaft supply path Sk1 and the crank shaft supply path Sk2 will decrease, and more oil will flow to the other oil branch supply paths Sk (variable valve timing mechanism supply path Sk3, oil jet supply path Sk4) (refer to FIG. 3, FIG. 7). Thus, it is possible to more quickly reach a hydraulic pressure of a level (for instance, 350 kPa) that is required for operating the variable valve timing mechanism.

In the engine lubrication control system, the control valve A starts its operation in a mid rotational range when the hydraulic pressure is, for example, 150 kPa. The first hydraulic control valve B starts its operation in a mid rotational range when the hydraulic pressure is, for example, 350 kPa. These are set to hydraulic pressures that are of at least a level in which the valve timing control (VTC) described later is operable with the foregoing hydraulic pressures.

Moreover, in a high rotational range of the engine, as a result of the control operation of the first hydraulic control valve (2-stage relief valve) B being added, the flow rate of the oil will increase (refer to FIG. 4), and the hydraulic pressure will suddenly rise. As a result of configuring the setting so that the second hydraulic control valve A is switched to a high rotational mode at a value (for example, between 350 and 600 kPa) of the hydraulic pressure midway during the sudden rise of the hydraulic pressure caused by the first hydraulic control valve (2-stage relief valve) B, the downstream hydraulic pressure of the cam shaft supply path Sk1 and the crank shaft supply path Sk2 can also be caused to suddenly rise in conjunction with the sudden rise of the upstream hydraulic pressure in the oil branch supply path Sk of the first hydraulic control valve B.

Figure 5:
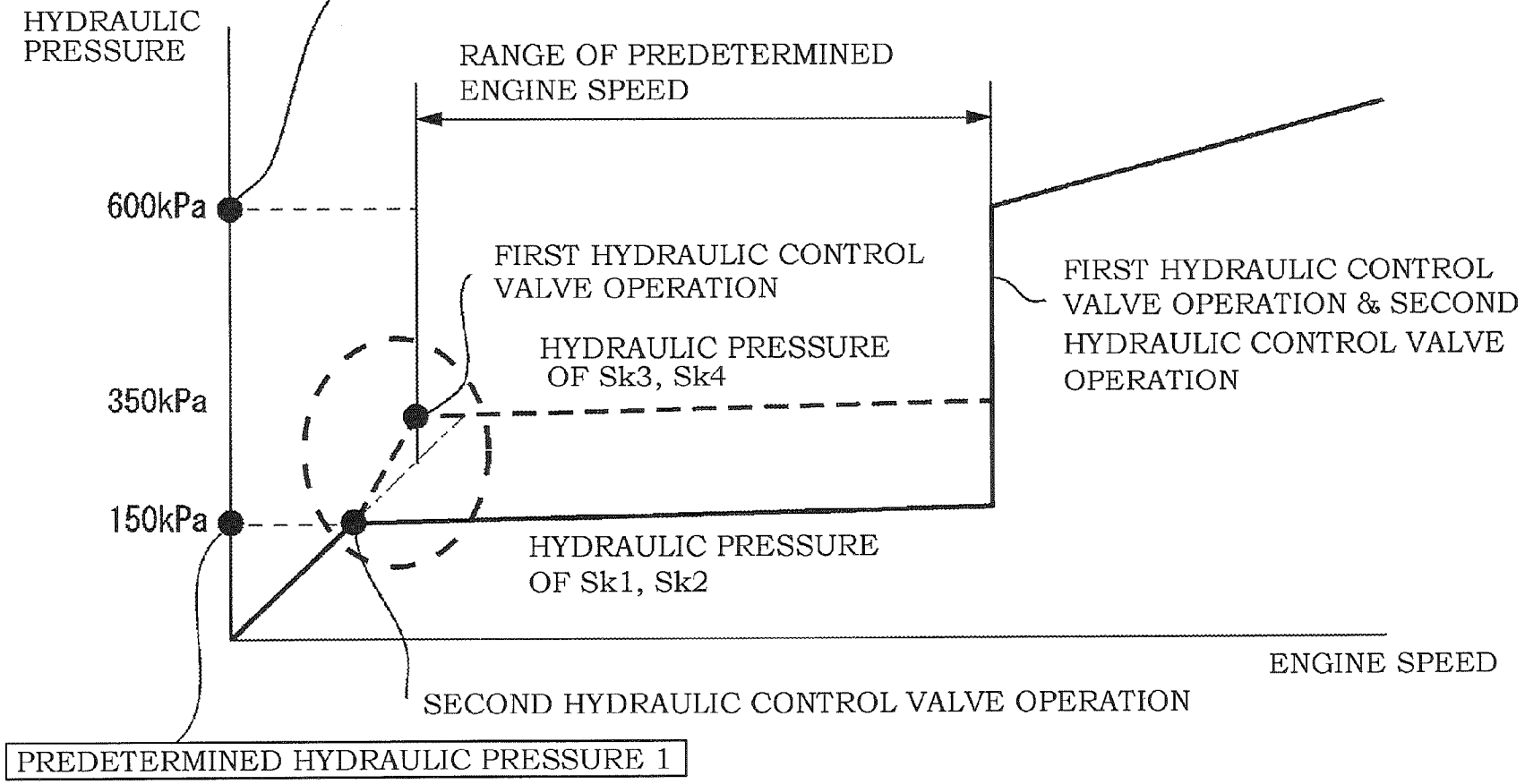
FIG. 5 is a graph showing the characteristics of the engine lubrication control system in the present invention.

This state is indicated in the graph shown in FIG. 5. Accordingly, the hydraulic control of the second hydraulic control valve A can be performed in conjunction with the hydraulic control of the first hydraulic control valve B.

Moreover, as described above, the second hydraulic control valve A directly uses its hydraulic pressure on the upstream side and the downstream side of the installed position of the channel cross-sectional area adjustment spool 41 in the main channel 11 and controls the flow rate by contracting and expanding (restoring) the channel cross-sectional area of the main channel 11. Thus, as the pressure of the oil that is flowing downstream and upstream of the main channel 11, a predetermined hydraulic pressure value 1 and a predetermined hydraulic pressure value 2 which is greater than the predetermined hydraulic pressure value 1 are set as the pressure range.

In addition, in the main channel, when the hydraulic pressure that is more upstream than the channel cross-sectional area adjustment spool 41 becomes the predetermined hydraulic pressure value 2, which is greater than the predetermined hydraulic pressure value 1, the channel cross-sectional area adjustment spool 41 is restored and the channel cross-sectional area of the main channel 11 is maximized. Consequently, the operation of the channel cross-sectional area adjustment spool 41 becomes accurate and highly responsive, and the friction of the oil pump 9 can be decreased without impairing the lubrication of the crank shaft.

Specifically, in FIG. 5, the predetermined hydraulic pressure value 1 is set to 150 kPa, and the predetermined hydraulic pressure value 2 is set to 600 kPa. The contraction and restoration (expansion) of the channel cross-sectional area of the main channel 11 are performed in the foregoing range.

What is claimed is:

1. An engine lubrication control system, comprising:

an engine;

an oil pump which is driven by the engine;

an oil circuit which extends downstream from the oil pump; and a plurality of oil branch supply paths which branch from the oil circuit and supply oil to each part of the engine, wherein a hydraulically-driven first hydraulic control valve which controls, in a stepwise manner, a discharge pressure of the oil pump relative to a speed of the engine is disposed on the oil circuit, wherein a hydraulically-driven second hydraulic control valve is disposed on at least one of the plurality of oil branch supply paths, wherein a downstream hydraulic pressure of the second hydraulic control valve is controlled to be lower than a downstream hydraulic pressure of the first hydraulic control valve of the oil circuit at least across a predetermined engine speed range, wherein the second hydraulic control valve is set to be switched to a high rotational mode at a value of the hydraulic pressure midway during a rise in the hydraulic pressure caused by the first hydraulic control valve, so that the downstream hydraulic pressure of the second hydraulic control valve is caused to rise in conjunction with the rise in the downstream hydraulic pressure of the first hydraulic control valve, wherein the second hydraulic control valve includes a channel cross-sectional area adjustment spool which changes a channel cross-sectional area of a main channel of the crank shaft supply path, and wherein, when the hydraulic pressure that is more upstream than the channel cross-sectional area adjustment spool becomes a second predetermined hydraulic pressure value, which is greater than a first predetermined hydraulic pressure value, the channel cross-sectional area adjustment spool is restored and the channel cross-sectional area of the main channel is maximized.

2. The engine lubrication control system according to claim 1, wherein the second hydraulic control valve is disposed on a crank shaft supply path or a cam shaft supply path among the plurality of oil branch supply paths.

3. The engine lubrication control system according to claim 2, wherein the downstream hydraulic pressure of the first hydraulic control valve of the oil circuit is controlled to be substantially the same as the downstream hydraulic pressure of the second hydraulic control valve, at an engine speed that is higher than the predetermined engine speed range.

4. The engine lubrication control system according to claim 2, wherein the engine speed when an operation the second hydraulic control valve is started is lower than the engine speed when an operation of the first hydraulic control valve is started.

5. The engine lubrication control system according to claim 2, wherein the channel cross-sectional area adjustment spool decreases the channel cross-sectional area of the main channel when a downstream hydraulic pressure of the channel cross-sectional area adjustment spool is greater than a first predetermined hydraulic pressure value, and the channel cross-sectional area adjustment spool is restored such that the channel cross-sectional area of the main channel is maximized when a hydraulic pressure that is more upstream than the channel cross-sectional area adjustment spool is a second predetermined hydraulic pressure value, which is greater than the first predetermined hydraulic pressure value.

6. The engine lubrication control system according to claim 2, wherein the second hydraulic control valve controls a hydraulic pressure of the cam shaft supply path and the crank shaft supply path to be lower than the hydraulic pressure that is controlled by the first hydraulic control valve across a range of a predetermined engine speed.

7. The engine lubrication control system according to claim 1, wherein the downstream hydraulic pressure of the first hydraulic control valve of the oil circuit is controlled to be substantially the same as the downstream hydraulic pressure of the second hydraulic control valve, at an engine speed that is higher than the predetermined engine speed range.

8. The engine lubrication control system according to claim 7, wherein the engine speed when an operation the second hydraulic control valve is started is lower than the engine speed when an operation of the first hydraulic control valve is started.

9. The engine lubrication control system according to claim 7, wherein the channel cross-sectional area adjustment spool decreases the channel cross-sectional area of the main channel when a downstream hydraulic pressure of the channel cross-sectional area adjustment spool is greater than a first predetermined hydraulic pressure value, and the channel cross-sectional area adjustment spool is restored such that the channel cross-sectional area of the main channel is maximized when a hydraulic pressure that is more upstream than the channel cross-sectional area adjustment spool is a second predetermined hydraulic pressure value, which is greater than the first predetermined hydraulic pressure value.

10. The engine lubrication control system according to claim 1, wherein the engine speed when an operation the second hydraulic control valve is started is lower than the engine speed when an operation of the first hydraulic control valve is started.

11. The engine lubrication control system according to claim 10, wherein the channel cross-sectional area adjustment spool decreases the channel cross-sectional area of the main channel when a downstream hydraulic pressure of the channel cross-sectional area adjustment spool is greater than a first predetermined hydraulic pressure value, and the channel cross-sectional area adjustment spool is restored such that the channel cross-sectional area of the main channel is maximized when a hydraulic pressure that is more upstream than the channel cross-sectional area adjustment spool is a second predetermined hydraulic pressure value, which is greater than the first predetermined hydraulic pressure value.

12. The engine lubrication control system according to claim 1, wherein the channel cross-sectional area adjustment spool decreases the channel cross-sectional area of the main channel when a downstream hydraulic pressure of the channel cross-sectional area adjustment spool is greater than a first predetermined hydraulic pressure value, and the channel cross-sectional area adjustment spool is restored such that the channel cross-sectional area of the main channel is maximized when a hydraulic pressure that is more upstream than the channel cross-sectional area adjustment spool is a second predetermined hydraulic pressure value, which is greater than the first predetermined hydraulic pressure value.

13. The engine lubrication control system according to claim 1, wherein in a mid-rotational range of the engine, the second hydraulic control valve is operated at a lower speed prior to the first hydraulic control valve being operated.

14. The engine lubrication control system according to claim 1, wherein in a low-rotational range of the engine, the second hydraulic control valve is operated from an engine speed that is lower than a minimum engine speed in a predetermined engine speed range.

15. The engine lubrication control system according to claim 1, wherein hydraulic control of the second hydraulic control valve is performed in conjunction with hydraulic control of the first hydraulic control valve.

16. The engine lubrication control system according to claim 1, wherein, in a low rotational range of the engine, both the first hydraulic control valve and the second hydraulic control valve are not operated.

17. The engine lubrication control system according to claim 1, wherein the second hydraulic control valve is disposed on a crank shaft supply path or a cam shaft supply path among the plurality of oil branch supply paths, wherein, in a low rotational range of the engine, both the first hydraulic control valve and the second hydraulic control valve are not operated such that an entire amount of oil is fed to the cam shaft supply path and the crank shaft supply path.

18. The engine lubrication control system according to claim 1, wherein the first hydraulic control valve and the second hydraulic control valve are hydraulically driven and controlled in conjunction with each other.

* * * * *